US007114955B2

(12) United States Patent
Poth

(10) Patent No.: US 7,114,955 B2
(45) Date of Patent: Oct. 3, 2006

(54) CONTACT ARRANGEMENT WITH CONTACT PIECES GUIDED TOWARDS EACH OTHER AND ARE DISPLACED IN A LONGITUDINAL MANNER AND A ROLLER-TYPE CONTACTS FOR MAKING CONTACT IN ONE SUCH CONTACT ARRANGEMENT

(75) Inventor: Rainer Poth, Bad Vilbel (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/505,593

(22) PCT Filed: Feb. 4, 2003

(86) PCT No.: PCT/DE03/00621

§ 371 (c)(1),
(2), (4) Date: Aug. 25, 2004

(87) PCT Pub. No.: WO03/073561

PCT Pub. Date: Sep. 4, 2003

(65) Prior Publication Data

US 2005/0106900 A1 May 19, 2005

(30) Foreign Application Priority Data

Feb. 25, 2002 (DE) ..... 102 08 704

(51) Int. Cl.
*H01R 39/00* (2006.01)

(52) U.S. Cl. ..... 439/17

(58) Field of Classification Search ..... 439/17, 439/18, 16, 28, 29, 20
See application file for complete search history.

(56) References Cited

U.S. PATENT DOCUMENTS

| | | | | |
|---|---|---|---|---|
| 3,271,723 | A * | 9/1966 | Willing | 439/17 |
| 3,301,986 | A | 1/1967 | Frink | |
| 4,183,598 | A | 1/1980 | Aarninkhof | |
| 5,395,247 | A | 3/1995 | Garzon | |
| 5,853,294 | A * | 12/1998 | Rehder | 439/17 |
| 6,386,885 | B1 * | 5/2002 | Ford | 439/17 |

FOREIGN PATENT DOCUMENTS

| | | |
|---|---|---|
| DE | 1194953 B | 6/1965 |
| DE | 8535717 U1 | 4/1986 |
| DE | 9300421 U1 | 4/1993 |
| GB | 1242297 | 8/1971 |
| GB | 1592221 | 7/1981 |

* cited by examiner

*Primary Examiner*—Phuong Dinh
(74) *Attorney, Agent, or Firm*—Morrison & Foerster LLP

(57) ABSTRACT

In order to simplify the construction and to reduce the size of a contact arrangement (1) comprising at least one outer contact piece (3) and at least one inner contact piece (5) which are guided towards each other such that they can be displaced in a longitudinal manner, also comprising a roller-type contact (2) provided with contact rollers (7), arranged for electrically conductive connection between the inner contact piece (5) and the outer contact piece (3), the or at least one outer contact piece (3) comprises a recess (4) with a concave cross-sectional defining wall, wherein the rolling contact is at least partially arranged (2) for the transfer of current. The invention also relates to a roller-type contact (2) for one such contact arrangement.

9 Claims, 2 Drawing Sheets

CONTACT ARRANGEMENT WITH CONTACT PIECES GUIDED TOWARDS EACH OTHER AND ARE DISPLACED IN A LONGITUDINAL MANNER AND A ROLLER-TYPE CONTACTS FOR MAKING CONTACT IN ONE SUCH CONTACT ARRANGEMENT

CLAIM FOR PRIORITY

This application is a national stage application under 371 based on PCT/DE03/00621, published in the German language on Sep. 4, 2003, which claims priority to German Application No. 102 08 704.0, which was filed on Feb. 25, 2002.

TECHNICAL FIELD OF THE INVENTION

The invention relates to a contact arrangement with contact pieces guided to move in a longitudinal direction and to a roller-type contact for making contact in such an arrangement.

BACKGROUND OF THE INVENTION

A contact arrangement and such a roller-type contact are disclosed in the German utility model G 93 00 421.4. The roller-type contact known to date has contact rollers which are arranged at both ends of a contact bolt, which can move in its longitudinal direction, between two stationary contact bolts, each contact roller resting with two frustoconical rolling bodies on the one hand against the moveable contact bolt and on the other hand against one of the stationary contact bolts. In order to guide the moveable contact bolt such that it can move in the longitudinal direction, the rolling bodies are arranged such that they can rotate freely on a rotation axis which has two end flanges at its ends. Furthermore, two prestressed helical springs are provided which are supported on the one hand on the end flanges and on the other hand on the rolling bodies, which produces a pressure force for the rolling bodies on the contact bolts which is required for making the contact. The rolling bodies are produced from an electrically conductive material, which means that the contact bolts are electrically connected to one another. The contact arrangement known to date comprises the contact pieces and the contact rollers arranged in pairs.

The contact arrangement known to date has the disadvantage that indispensable, additional shielding elements are required to shield the contact point between the roller-type contact and the contact bolt in respect of the wear which takes places as well as for safety reasons. This makes the design of power electronics modules more expensive and results in complex assemblies.

SUMMARY OF THE INVENTION

The invention relates to a contact arrangement having at least one outer contact piece and at least one inner contact piece, which are guided such that they can move in the longitudinal direction with respect to one another, and having a roller-type contact, which has contact rollers and is arranged between the inner contact piece and the outer contact piece so as to make the electrically conductive connection.

The invention also relates to a roller-type contact for making contact between at least one outer contact piece and at least one inner contact piece, which are guided such they can move in a displacement direction with respect to one another, the roller-type contact having at least one contact roller which has rolling bodies, which rest against the or against one of the outer contact pieces and against the or against one of the inner contact pieces and connects said outer and inner contact pieces electrically conductively to one another, at least one spring element for providing the necessary pressure force for the rolling bodies, and a rotation axis.

The invention therefore provides a contact arrangement of the type mentioned initially which has a simple and compact design.

The invention also provides a roller-type contact of the type mentioned initially which can be used in a contact arrangement according to the invention.

In one embodiment of the invention, at least one of the outer contact pieces has an opening having a limit wall which is concave in cross section, the roller-type contact being arranged at least partially in the opening for transferring the current.

In the roller-type contact embodiment, the spring element is a compression spring which is arranged between the rolling bodies.

Owing to the arrangement of the spring element between the rolling bodies, the rolling bodies are no longer pressed inwards from the outside, as in the prior art, but, conversely, are pressed outwards from the inside. Owing to this design measure, it is now possible for the roller-type contacts to be used in the inner region of an outer contact piece which is at least partially concave in cross section. The inner contact piece may also protrude at least partially into the inner region. The spring element therefore presses the rolling bodies on the one hand against the concave inner wall of the opening of the outer contact piece and on the other hand against the outer surface of the inner contact piece. In this case, the contact arrangement is shielded from the outside by the outer contact piece owing to the encapsulation produced. According to the invention, additional shielding of the entire contact arrangement is thus dispensed with, which improves the production, design and compactness of the overall assembly.

In one preferred embodiment of the invention, the outer contact piece is a stationary contact tube, in which the inner contact piece is arranged as a contact bolt which is guided such that it can move in the longitudinal direction. In this embodiment, the opening is thus the interior of a hollow-cylindrical and thus concave contact tube. The concave inner wall or limit wall of the outer contact piece is sealed around the circumference in this embodiment, which further improves the encapsulation or shielding of the contact arrangement.

In another embodiment, the contact bolt has, at mutually opposing ends, longitudinal grooves which are concave in cross section and are each provided for accommodating contact rollers. Owing to a likewise concave design such as this of the inner contact piece, contact faces of the rolling bodies brush over both contact faces of the outer contact piece and contact faces of the inner contact piece when the rolling bodies are completely rotated. A transverse offset of these contact faces which is otherwise required is dispensed with in this embodiment, which increases the overall size of the contact faces.

In an alternative embodiment, the outer contact piece is a stationary contact tube, in which the inner contact piece is guided such that it can move in the longitudinal direction, the inner contact piece having a contour which is star-shaped in cross section, such that sub regions are delimited between the inner contact piece and the contact tube, the contact rollers being arranged in said subregions. In this embodiment, at least three subregions are arranged around the circumference of the inner contact piece which can move in the longitudinal direction, which for one thing improves the guidance of this contact piece. Furthermore, however, the contact face between the roller-type contacts and the contact pieces is also increased in size, which reduces the extent to which the contact arrangement is heated.

In still another embodiment, the longitudinal grooves have a curvature in cross section, whose radius is equal to the radius of the contact tube. This design measure prevents contact faces which are offset with respect to one another in cross section on the contact rollers.

In one advantageous embodiment of the roller-type contact according to the invention, the rolling bodies are in the form of collars, which makes it possible to use inner contact pieces which have a star-shaped contour in cross section and delimit at least three subregions within a contact tube.

In an alternative embodiment, the rolling bodies may be frustoconical. This embodiment is particularly advantageous when the inner contact piece is in the form of a cylindrical contact bolt and has longitudinal grooves, which are round in cross section and are provided in each case for accommodating the roller-type contact, at both of its ends.

The roller-type contact according to the invention may be comprised of a contact roller or of two or more contact rollers, which are connected to one another via a connection device, the connection device having no influence on the ability of the rolling bodies to roll.

According to the invention, any compression springs may be used. Helical springs, spiral springs, disk springs, elastomer springs or pneumatic springs are mentioned by way of example.

BRIEF DESCRIPTION OF THE DRAWINGS

Embodiments and advantages of the invention are described below in more detail with reference to the figures in the drawings, in which.

DETAILED DESCRIPTION OF THE INVENTION

Figure 1:
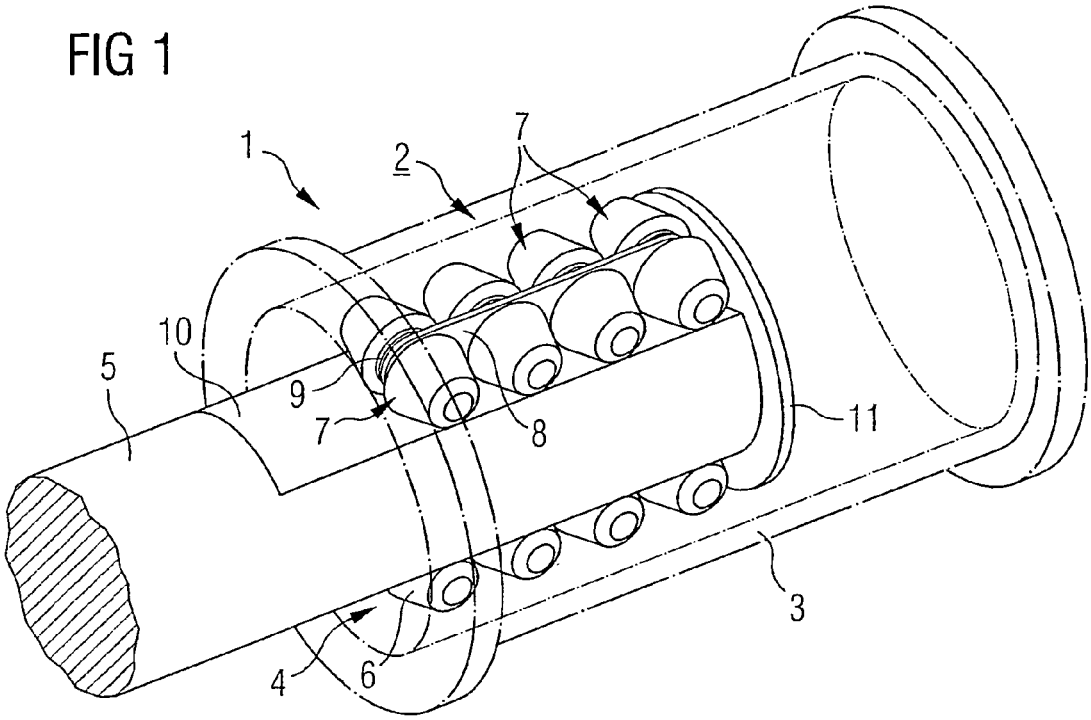
FIG. 1 shows a perspective illustration of an exemplary embodiment of the contact arrangement according to the invention having a roller-type contact according to the invention.

FIG. 1 shows a perspective illustration of an exemplary embodiment of the contact arrangement 1 according to the invention using roller-type contacts 2 according to the invention, in which there is a transparent illustration of a stationary, outer conduit 3 in order also to be able to illustrate components which are arranged hidden in its interior.

The contact arrangement 1 comprises the stationary conduit 3 as an outer contact piece and a contact bolt 5, which is guided such that it can move in the longitudinal direction and protrudes into an opening 4 in the conduit 3, as the inner contact piece. Supported on the conduit 3 and the contact bolt 5 are in each case rolling bodies 6 of the roller-type contact 2 composed of two or more contact rollers 7. The contact rollers 7 are fixedly connected to one another via a connection device 8. The connection device 8 expediently acts on the rotation axes described in more detail later on and is connected to said rotation axes such that it is secure against rotation. In such an embodiment, each contact roller 7 has two compression springs 9 which are each supported on the connection device 8 and on the roller body 6.

For accommodating the roller-type contacts 2, the contact bolt 5 has longitudinal grooves 10 which have a curvature in cross section.

In order to prevent the roller-type contacts 2 from sliding away from the contact bolt 5, a locking limit flange 11 is provided at the end of said contact bolt 5.

Figure 2:
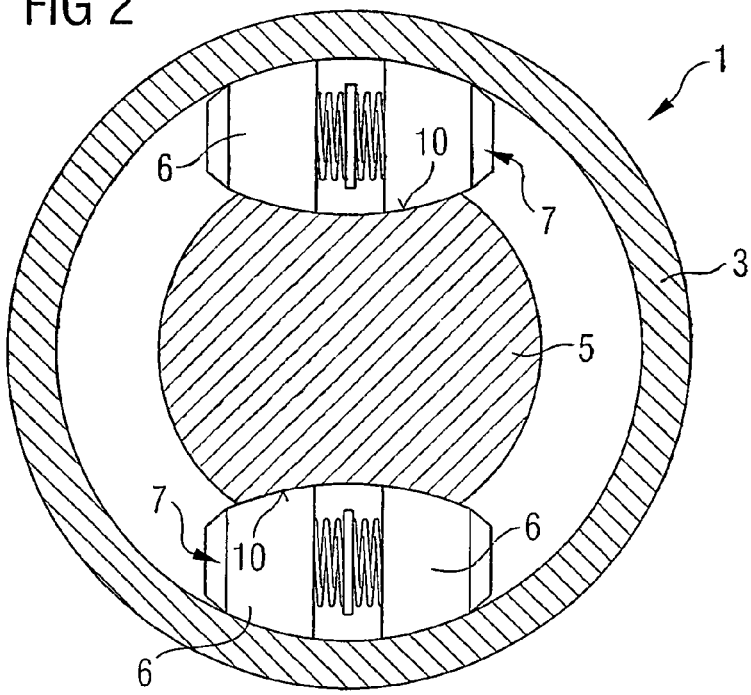
FIG. 2 shows a partially cross-sectional view of the contact arrangement and the roller-type contact shown in FIG. 1.

FIG. 2 shows a cross-sectional end view of the contact arrangement 1 and the roller-type contacts 2 shown in FIG. 1. It can be seen in this illustration that the rolling bodies 6 of the contact rollers 7 are frustoconical and have a flattened contact-free tip. The longitudinal groove 10 in the contact bolt 5 has a curvature. In other words, it delimits a circle segment, the radius of this circle segment or this curvature essentially corresponding to the radius of the envelope of the frustoconical rolling bodies 6 and thus the inner radius of the conduit 3.

Figure 3:
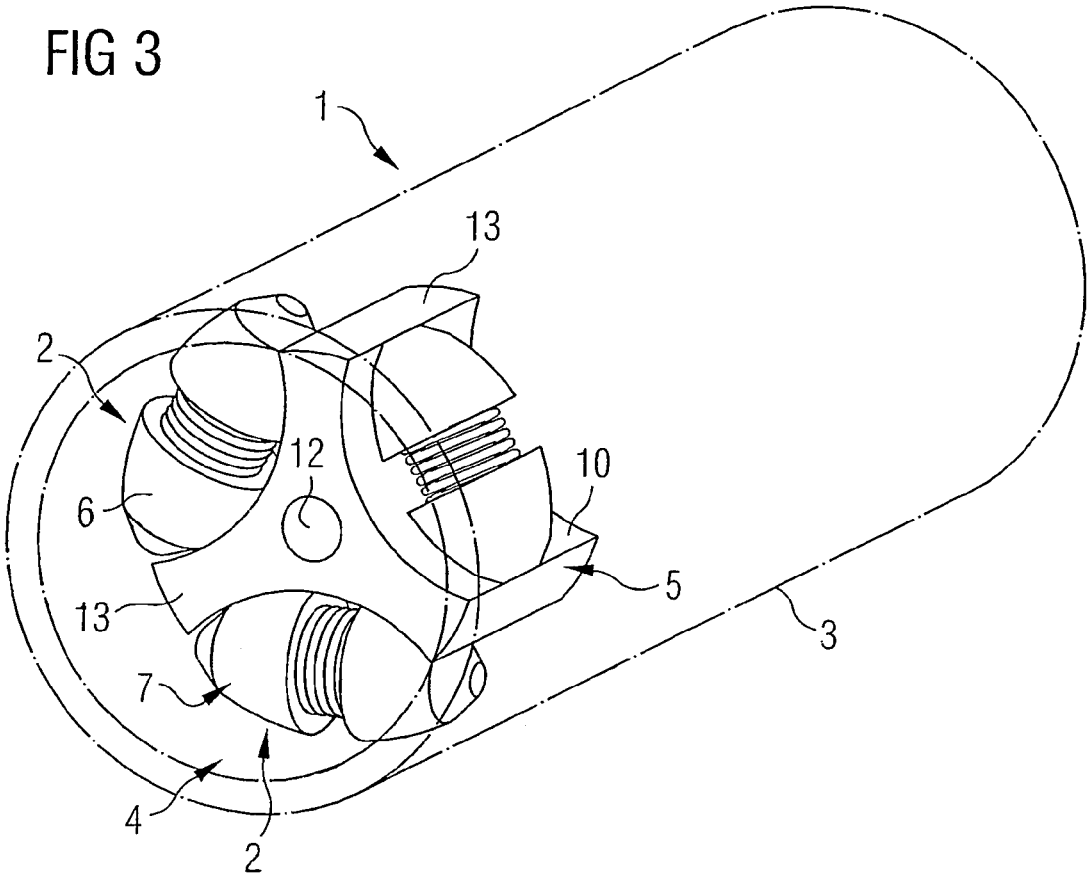
FIG. 3 shows an alternative exemplary embodiment of the contact arrangement according to the invention and of the roller-type contact according to the invention.

FIG. 3 shows a perspective illustration of a further exemplary embodiment of the contact arrangement 1 according to the invention having the roller-type contacts 2 according to the invention. The inner contact piece 5 shown here is no longer cylindrical but has a contour which is star-shaped in cross section and a central through-opening 12 which is provided for the purpose of connecting extension means such as connecting rods or the like. When viewed in more detail, the inner contact piece 5 has webs 13 which form an angle with one another of 60°. In this case, the webs 13 merge into one another so as to form an arc, whereby they delimit longitudinal grooves 10. The longitudinal grooves 10 are thus curved in cross section, the radius of this curvature being matched to the contour of the collar-shaped rolling bodies 6 of the contact rollers 7. The fact that the inner contact piece 5 which is moveable in its longitudinal direction is supported and guided three times in the opening 4 in the conduit 3 increases the stability of the contact arrangement 1.

Figure 4:
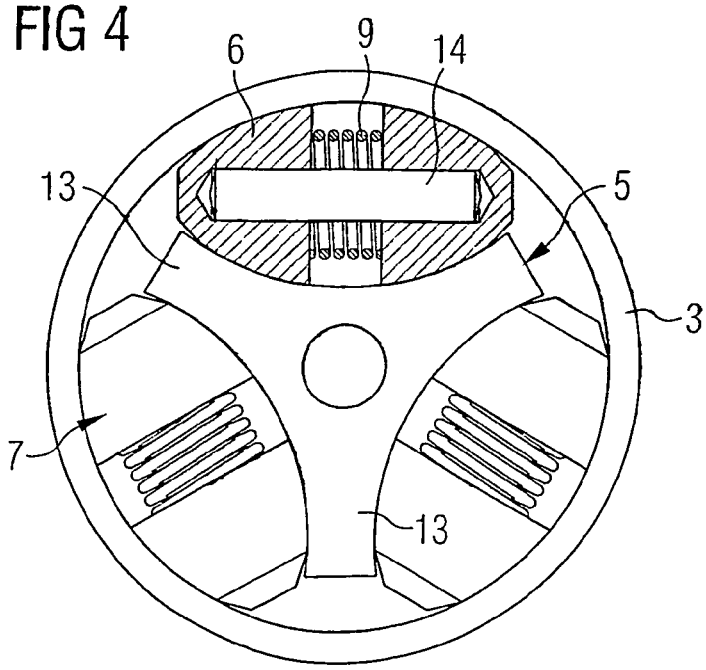
FIG. 4 shows a partially cross-sectional end view of the contact arrangement and of the roller-type contact shown in FIG. 4.

FIG. 4 shows a partially sectioned end view of the contact arrangement 1 shown in FIG. 3. In particular in this view, it can be seen that the rolling bodies 6 are pushed loosely onto rigid rotation axes 14, with the result that the compression spring comprising disk springs 9 arranged in a row presses the rolling bodies 6 against the inner wall of the conduit 3 and the inner contact piece 5 arranged in the opening 4.

Naturally, it also possible in the context of the invention to provide securing flanges on the rotation axis 14 which engage in openings in the rolling bodies 6 which are expediently included but are not illustrated in the figures, with the result that, on the one hand, a contact roller 7 is prevented from falling over when it is removed from the conduit, and, on the other hand, the rolling bodies 6 on the rotation axis 14 are displaced to a sufficient extent to produce the pressure.

In the exemplary embodiment illustrated in FIG. 4, a connection means is dispensed with. The disk springs arranged in a row merely form a compression spring 9.

The invention claimed is:

1. A contact arrangement, comprising:

at least one outer contact piece and at least one inner contact piece, which are guided to move in a longitudinal direction with respect to one another; and a roller-type contact, which has contact rollers and is arranged between the inner contact piece and the outer contact piece forming an electrically conductive connection, wherein the at least one of the outer contact piece has an opening having a limit wall which is concave in cross section, roller-type contact being arranged at least partially in the opening for transferring the current, the outer contact piece is a stationary contact tube, in which the inner contact piece is arranged as a contact bolt which is guided to move in the longitudinal direction, and the contact bolt has, at mutually opposing sides, longitudinal grooves which are concave in cross section and are each provided for accommodating contact rollers.

2. The contact arrangement as claimed in claim 1, wherein each longitudinal groove has a curvature in cross section, whose radius is equal to an inner radius of the contact tube.

3. The contact arrangement according to claim 1, further comprising a roller-type contact having at least one contact roller which has rolling bodies, which rest against the at least one of outer contact piece and against at least of the inner contact pieces and connects the outer and inner contact pieces electrically conductively to one another, at least one spring element for providing a pressure force for the rolling bodies, and a rotation axis.

4. The contact arrangement according to claim 2, further comprising a roller-type contact having at least one contact roller which has rolling bodies, which rest against the at least one of outer contact piece and against at least of the inner contact pieces and connects the outer and inner contact pieces electrically conductively to one another, at least one spring element for providing a pressure force for the rolling bodies, and a rotation axis.

5. The contact arrangement according to claim 3, wherein the spring element is a compression spring which is arranged between the rolling bodies.

6. The roller-type contact as claimed in claim 5, wherein the rolling bodies are in a form of collars.

7. The contact arrangement as claimed in claim 5, wherein two or more contact rollers are provided which are connected to one another via a connection device.

8. A contact arrangement, comprising:

at least one outer contact piece and at least one inner contact piece, which are guided to move in a longitudinal direction with respect to one another; and a roller-type contact, which has contact rollers and is arranged between the inner contact piece and the outer contact piece forming an electrically conductive connection, wherein the at least one of the outer contact piece has an opening having a limit wall which is concave in cross section, roller-type contact being arranged at least partially in the opening for transferring the current, the outer contact piece is a stationary contact tube, in which the inner contact piece is arranged as a contact bolt which is guided to move in the longitudinal direction, and the outer contact piece is a stationary contact tube, in which the inner contact piece is guided to move in the longitudinal direction, the inner contact piece having a contour which is star-shaped in cross section, such that subregions are delimited between the inner contact piece and the contact tube, contact rollers being arranged in the subregions.

9. The contact arrangement according to claim 8, further comprising a roller-type contact having at least one contact roller which has rolling bodies, which rest against the at least one of outer contact piece and against at least of the inner contact pieces and connects the outer and inner contact pieces electrically conductively to one another, at least one spring element for providing a pressure force for the rolling bodies, and a rotation axis.

* * * * *

UNITED STATES PATENT AND TRADEMARK OFFICE

CERTIFICATE OF CORRECTION

PATENT NO. : 7,114,955 B2
APPLICATION NO. : 10/505593
DATED : October 3, 2006
INVENTOR(S) : Rainer Poth It is certified that error appears in the above-identified patent and that said Letters Patent is hereby corrected as shown below:

On the title page, item [22]
The PCT filing date:

Delete "February 4, 2003" and replace with --February 24, 2003--

Signed and Sealed this

Twenty-second Day of May, 2007

JON W. DUDAS
*Director of the United States Patent and Trademark Office*